US005092831A

United States Patent [19]

James et al.

[11] Patent Number: 5,092,831

[45] Date of Patent: Mar. 3, 1992

[54] METHOD OF AND APPARATUS FOR OPENING A FOLDED WEB OF HEAT-SEALABLE PACKAGING MATERIAL PRIOR TO FORMATION OF THE WEB INTO SEALED RECLOSABLE PACKAGES

[75] Inventors: Robert C. James; Lloyd Kovacs, both of Sheboygan, Wis.

[73] Assignee: Hayssen Manufacturing Co., Sheboygan, Wis.

[21] Appl. No.: 598,045

[22] Filed: Oct. 16, 1990

[51] Int. Cl.[5] ..... B65B 9/06

[52] U.S. Cl. ..... 493/394; 53/410; 53/133.4; 53/139.2; 53/568; 53/64; 53/389.4; 493/410; 493/927

[58] Field of Search ..... 53/410, 451, 133.4, 53/139.2, 568, 551; 156/66; 493/213, 214, 394, 409, 410, 927

[56] References Cited

U.S. PATENT DOCUMENTS 4,519,185 5/1985 Horn ..... 53/568 X 4,704,842 11/1987 Boeckman ..... 53/568 X 5,014,498 5/1991 McMahon ..... 493/213

*Primary Examiner*—John Sipos

*Attorney, Agent, or Firm*—Senniger, Powers, Leavitt & Roedel

[57] ABSTRACT

A method of opening a folded web of flexible heat-sealable packaging material prior to formation of the material into sealed reclosable packages. The web has a pair of interlockable reclosable closure strips extending longitudinally of the web on an inside face of the web, and one section of the web is folded over on another section of the web so that the closure strips are interlocked. The method comprises advancing the folded web in a first plane to a web-opening station, and opening the folded web while maintaining the closure strips interlocked as the web advances through the web-opening station. The web is opened by diverting both sections of the web relative to one another so that they assume a coplanar position in a second plane different from the first plane.

30 Claims, 14 Drawing Sheets

METHOD OF AND APPARATUS FOR OPENING A FOLDED WEB OF HEAT-SEALABLE PACKAGING MATERIAL PRIOR TO FORMATION OF THE WEB INTO SEALED RECLOSABLE PACKAGES

BACKGROUND OF THE INVENTION

This invention relates generally to the manufacture of sealed packages of the type comprising a bag length of tubing of flexible packaging material having heat seals at the ends for sealing product therein, the packages being of the type, e.g. the pillow type with or without gussets, three-side or four-side sealed packages, that may be produced, for example, by a vertical form-fill-seal machine (a "VFFS" machine) such as that disclosed in U.S. Pat. No. 4,288,965 of Robert C. James, issued Sept. 15, 1981 to Hayssen Manufacturing Company of Sheboygan, Wis., denoted the ULTIMA® machine, ReExamination Certificate B1 4,288,965 issued Mar. 26, 1985, and by a horizontal form-fill-seal machine (an "HFFS" machine) such as that disclosed in U.S. Pat. No. 3,274,746 of Robert C. James et al. issued Sept. 27, 1966 to Hayssen Manufacturing Company, denoted the RT machine.

The invention is more particularly directed to the manufacture of sealed reclosable packages of the type described in pending U.S. patent application Ser. No. 477,291 now abandoned and a pending continuation-in-part thereof, Ser. No. 499,951, both assigned to Hayssen Manufacturing Company. This package has a reclosable (resealable) closure extending lengthwise of the package inwardly of and adjacent one side edge of the package, and a built-in easy open feature involving a cutting string disposed inside the bag adjacent the one side edge of the bag, the string being accessible so that it may be pulled to cut the bag along the one side of the bag to open it without the use of extraneous means such as a scissors or knife.

The flexible packaging material used in the production of reclosable bags of the type described above is manufactured in web form, the web having a pair of spaced-apart parallel reclosable closure strips (e.g., an elongate channel member and a mating tongue member) extending longitudinally of the web on one face of the web inwardly from one side edge of the web, and a cutting string on the one face of the web extending between the closure strips and generally parallel thereto. For ease of handling and shipment, and to prevent damage to the closure strips prior to manufacture of the web into packages, the web is typically wound in roll form with the web, as wound, in a folded condition in which the web is folded along a fold line extending generally midway between and parallel to the closure strips (immediately adjacent the cutting string) so that a portion of the web between the fold line and the one side edge of the web is folded over on the web, with the closure strips interlocked.

In the manufacture of packages from such web material, as by a horizontal form-fill-seal ("HFFS") machine or a vertical form-fill-seal ("VFFS") machine, folded web is fed from a supply roll, opened (unfolded) in such a way that the closure strips remain interlocked, and then fed to the packaging machine. Heretofore, the web-opening step has been accomplished by unfolding the folded-over portion 180° relative to the remainder of the web (with the closure strips remaining interlocked). However, this method causes uneven tensioning of the web across its width as the web is pulled forward, which in turn causes inaccurate tracking of the web as it travels to the bag-forming apparatus, and other problems.

SUMMARY OF THE INVENTION

Among the several objects of this invention may be noted the provision of an improved method and apparatus for opening a folded web of flexible packaging material prior to the web being formed into packages, particularly web of the type having thermoplastic reclosable closure strips secured thereto; the provision of such method and apparatus wherein the folded web is spread open in such a way as to avoid uneven tensioning of the web, while maintaining the closure strips interlocked, thereby providing for more accurate tracking of the web as it is fed to a package-forming machine; the provision of such method and apparatus which involves pre-sealing the folded web to flatten and pre-seal the closure strips in the areas corresponding to the end seals of packages to be formed, thereby facilitating the manufacture of the packages and increasing the integrity of the ends seals; the provision of such method and apparatus which is designed for precise guiding of the web as it is pre-sealed, opened and fed forward to package-making apparatus; the provision of such apparatus which is operable to meet either continuous or intermittent demand from a packaging machine; the provision of such apparatus wherein the position of the web is adjustable laterally to align the web with downstream packaging apparatus; and the provision of such apparatus which is under the control of a programmable controller to facilitate adjustment of the apparatus according to the size of the packages to be formed, the rate of production and other factors.

In one aspect, the method of this invention involves opening a folded web of flexible heat-sealable packaging material prior to formation of the material into sealed reclosable packages, the web having generally parallel side edges extending longitudinally of the web, and a pair of interlocking reclosable closure strips extending longitudinally of the web on an inside face of the web. The closure strips divide the web into a plurality of sections extending longitudinally of the web, including a first section extending between one side edge of the web and one closure strip and a second section extending between the other closure strip and the other side edge of the web. The web is folded along a fold line extending between and generally parallel to the closure strips so that the second section of the web is folded over with its inside face flat against the inside face of the first section of the web and with the closure strips interlocked. In this aspect the method comprises (1) advancing the folded web, with the first and second sections of the web disposed in a first plane and the closure strips interlocked, to a web-opening station, and (2) opening the folded web while maintaining the closure strips interlocked as the web advances through the web-opening station by diverting the first section of the web out of said first plane to lie in a second plane different from the first plane, and by diverting the second section of the web out of the first plane to a lie in the second plane so that the first and second sections of the web are co-planar in said second plane and unfolded relative to one another, the closure strips remaining interlocked as the first and second sections of the web are diverted.

The apparatus for carrying out the above method comprises means for holding a supply of folded web for travel of web fed from the supply along a predetermined path through the apparatus, a web-opening station adjacent said path, folded web approaching the station being disposed in a first plane, and web-opening means for opening the folded web in the manner described above in connection with the method of this invention.

In another aspect, the method of this invention involves preparing a folded web of flexible heat-sealable packaging material for formation of the web into sealed reclosable packages. This involves the steps of intermittently advancing the folded web in package-length increments, with a dwell between successive advances, to a pressing station, and flattening the closure strips at package length intervals during the dwells in areas in which the web is to be heat sealed in a subsequent forming operation.

Apparatus for carrying out this latter aspect of the method of the present invention comprises means for holding a supply of folded web for travel of web fed from the supply along a predetermined path through the apparatus, a pressing station along the path downstream from the supply, and press means at the pressing station for flattening the closure strips at package-length intervals in areas in which the web is to be heat sealed in a subsequent forming operation.

Other objects and features will be in part apparent and in part pointed out hereinafter.

BRIEF DESCRIPTION OF THE DRAWINGS

Corresponding reference numerals designate corresponding parts throughout the several views of the drawings.

DETAILED DESCRIPTION OF PREFERRED EMBODIMENTS

Figure 1:
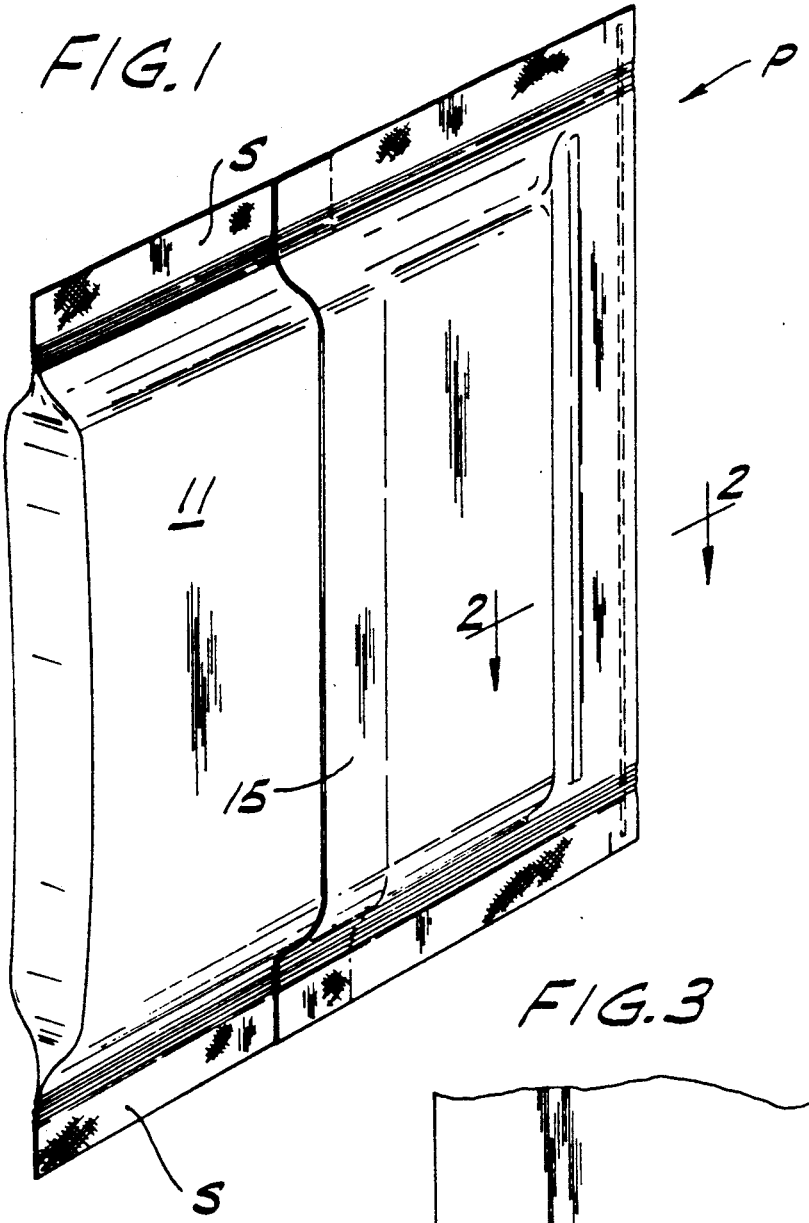
FIG. 1 is a perspective of a package of a type to be made in connection with the method and apparatus of this invention.
Figure 2:
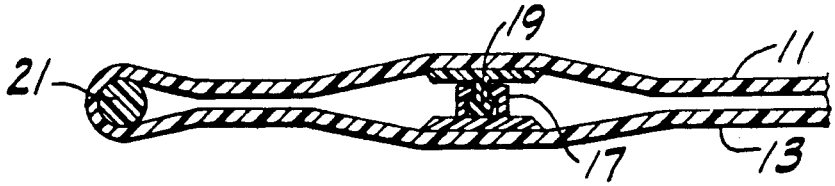
FIG. 2 is an enlarged section taken on line 2—2 of FIG. 1 showing interlocking reclosable closure strips and a cutting string of the package.

Referring now to the drawings, the invention is shown as it relates to the handling and treatment of a web W of flexible heat-sealable packaging material prior to formation of the material into sealed reclosable packages of the type shown in FIGS. 1 and 2 and described in detail in co-pending and co-assigned applications Ser. Nos. 477,291 and 499,951, which are incorporated herein by reference. In general, this package P comprises a bag made of material which is heat sealable at least on one side which constitutes the inside of the bag. The bag has opposed walls 11, 13 and a longitudinal overlap heat sealed seam 15 extending along one of these walls. The ends of the bag are closed by heat seals S between the walls, each of these seals being a flat seal. The package is provided with a pair of interlocking reclosable closure strips 17, 19 extending lengthwise of the bag from one end to the other and inwardly of and adjacent one side of the bag. The package, as initially supplied, has its contents disposed between these reclosable closure strips (which are initially interlocked and closed) and the other side of the package, the arrangement being such that after cutting the bag open, as by means of a cutting string 21 described in the aforementioned co-pending applications, the reclosable closure strips may be opened for taking out part of the content and then closed to seal the remainder of the content. The reclosable closure strips are preferably of the type wherein one of the strips comprises an elongate channel member 17 of thermoplastic material sealed to one wall of the bag, e.g., wall 13 as illustrated, and extending lengthwise of the package, and wherein the other strip comprises a mating tongue member 19 of thermoplastic material sealed to the other wall (e.g., 11) and extending lengthwise of the package, the tongue member being receivable with a relatively tight fit in the channel member for sealing purposes while being readily disengageable from the channel member. These interlocking closure strips 17, 19 may be of the well-known ZIP-LOK type. They extend generally from one end seal S to the other. The cutting string 21 is also of a thermoplastic material sealed to an inside wall of the bag along the side of the bag and laterally outward of the closure strips. It too extends from one end seal S to the other.

Figure 3:
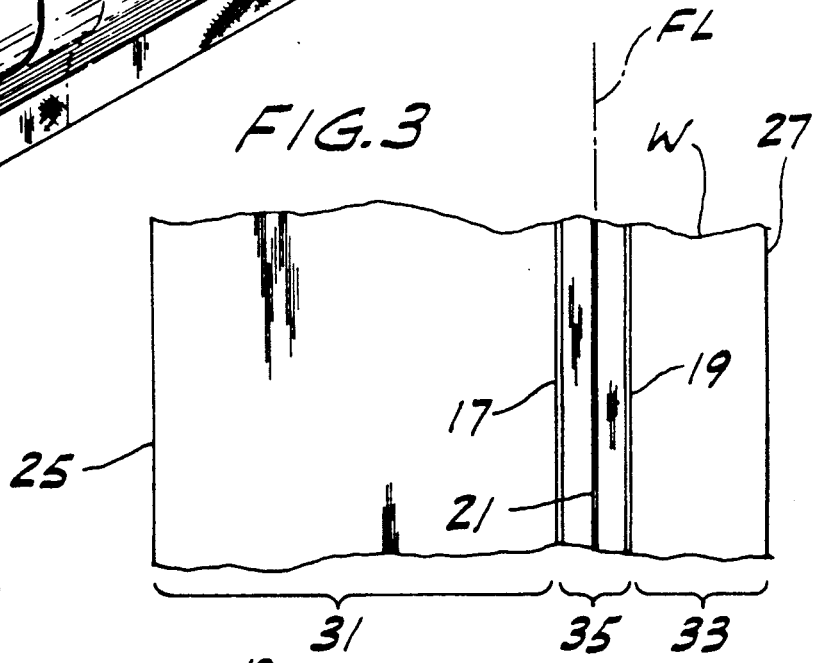
FIG. 3 is a longitudinal portion of a web of heat-sealable packaging material used in the manufacture of packages of the type shown in FIG. 1, the web being shown in a fully open or unfolded condition.

As illustrated in FIG. 3, the packaging material used to make the aforesaid type of package is a continuous web W of flexible heat-sealable plastic film, such as 1.5 mil polyethylene film, the web having generally parallel side edges 25, 27 extending longitudinally of the web, and the interlocking closure strips 17, 19 extending longitudinally of the web on an inside face of the web (corresponding to the inside of a bag to be made). The closure strips 17, 19 thus divide the web into a plurality of sections extending longitudinally of the web, including a first section 31 extending between one side edge (25) of the web and one closure strip (the channel member 17 as shown in FIG. 3), a second section 33 extending between the other closure strip (the tongue member 19) and the other side edge (27) of the web, and a third intermediate section 35 between the two closure strips. In packages to incorporate the aforementioned cutting string 21, the string extends longitudinally of the web on its inside face approximately midway between and parallel to the two closure strips 17, 19.

Figure 4:
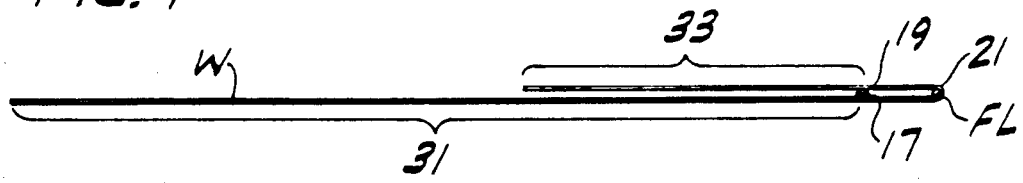
FIG. 4 is a transverse section of the web illustrating the web in a folded condition in which the closure strips are interlocked.

The packaging material is supplied to the bag manufacturer in rolls of continuous web with the web folded along a fold line FL extending midway between and generally parallel to the closure strips 17, 19 so that the second 33 section of the web is folded over with its inside face flat against the inside face of the first section 31 of the web and with the closure elements interlocked (see FIG. 4). The cutting string 21, if present, is located immediately adjacent the fold line FL. Prior to feeding of the web to a bag-making machine, such as a horizontal form-fill-seal ("HFFS") machine or a vertical form-fill-seal ("VFFS") machine, the first and second sections 31, 33 of web must be opened (unfolded) relative to one another, with the closure elements 17, 19 remaining interlocked so that product may be inserted in the package and the package sealed. The method and apparatus of this invention accomplish this unfolding step in an improved manner, and also serve to prepare the web for later formation of the package end seals S, as will be explained.

Figure 5:
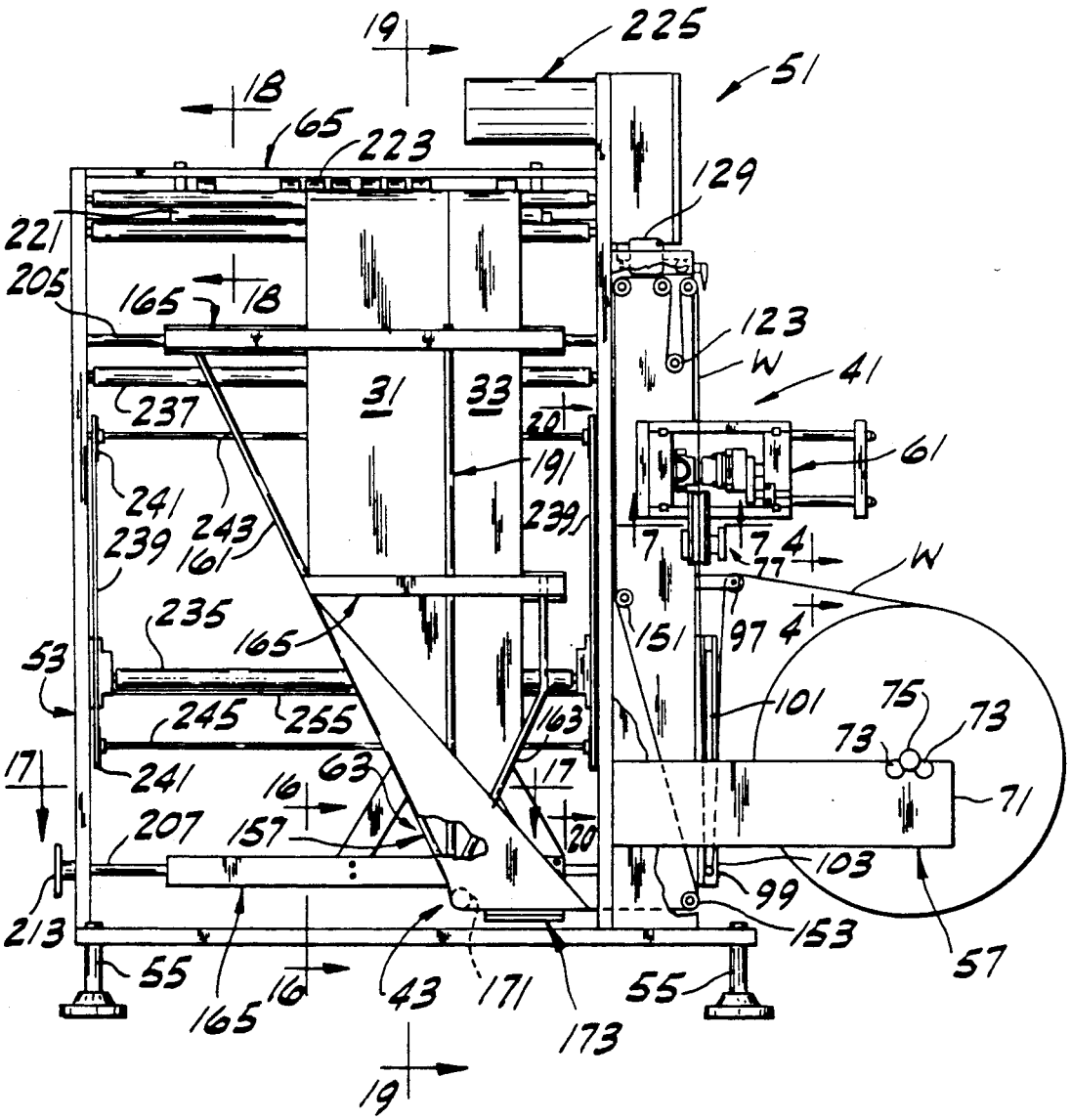
FIG. 5 is a front elevation of apparatus of the present invention operable to pre-seal and open a folded web of packaging material for delivery of the pre-sealed and opened web to packaging apparatus.

Referring to FIG. 5, this invention relates generally to a method of feeding a web W in the stated folded condition from a supply roll R, intermittently advancing the folded web in package-length increments, with a dwell between successive advances, to a pressing station 41, pressing and heating the web in an area including the interlocked closure strips 17, 19 to flatten and pre-seal them during the dwells at package length intervals corresponding to the package end seals S to be formed in a subsequent operation, thereby facilitating the formation of the end seals, and then advancing the folded web, with the first and second sections 31, 33 of the web being disposed in a first plane and with the closure strips interlocked, to a web-opening station 43. The method also involves opening the folded web while maintaining the closure strips interlocked as the web advances through the web-opening station. As will appear, the opening of the web is accomplished in such a way that the web sections 31, 33 are equally tensioned to facilitate delivery of the web to suitable package-forming apparatus, such as a VFFS or HFFS machine.

Apparatus of the present invention for carrying out the method described above is indicated in its entirety in FIG. 5 by the reference numeral 51. Briefly, the apparatus comprises an upstanding main frame generally designated 53 on legs 55, means 57 connected to the frame for holding a supply roll R of web W in the stated folded condition for travel of the web from the supply roll along a predetermined path through the apparatus, a press (press means, generally) indicated at 61 downstream from the supply roll for flattening and pre-sealing the folded web W in the area of the closure strips 17, 19 at package-length intervals corresponding to the package end seals S to be formed in a later operation, web-opening means 63 downstream from the press 61 for opening the folded web while maintaining the closure strips 17, 19 interlocked, and web feeding and measuring means 65 downstream from the web-opening means adjacent the top of the frame 53 for measuring package length increments of web and intermittently feeding (pulling) such increments forward for exit of the web from the apparatus. The web feeding and measuring means 65 effects the movement of the web through the press 61 and past the web-opening means 63.

Figure 6:
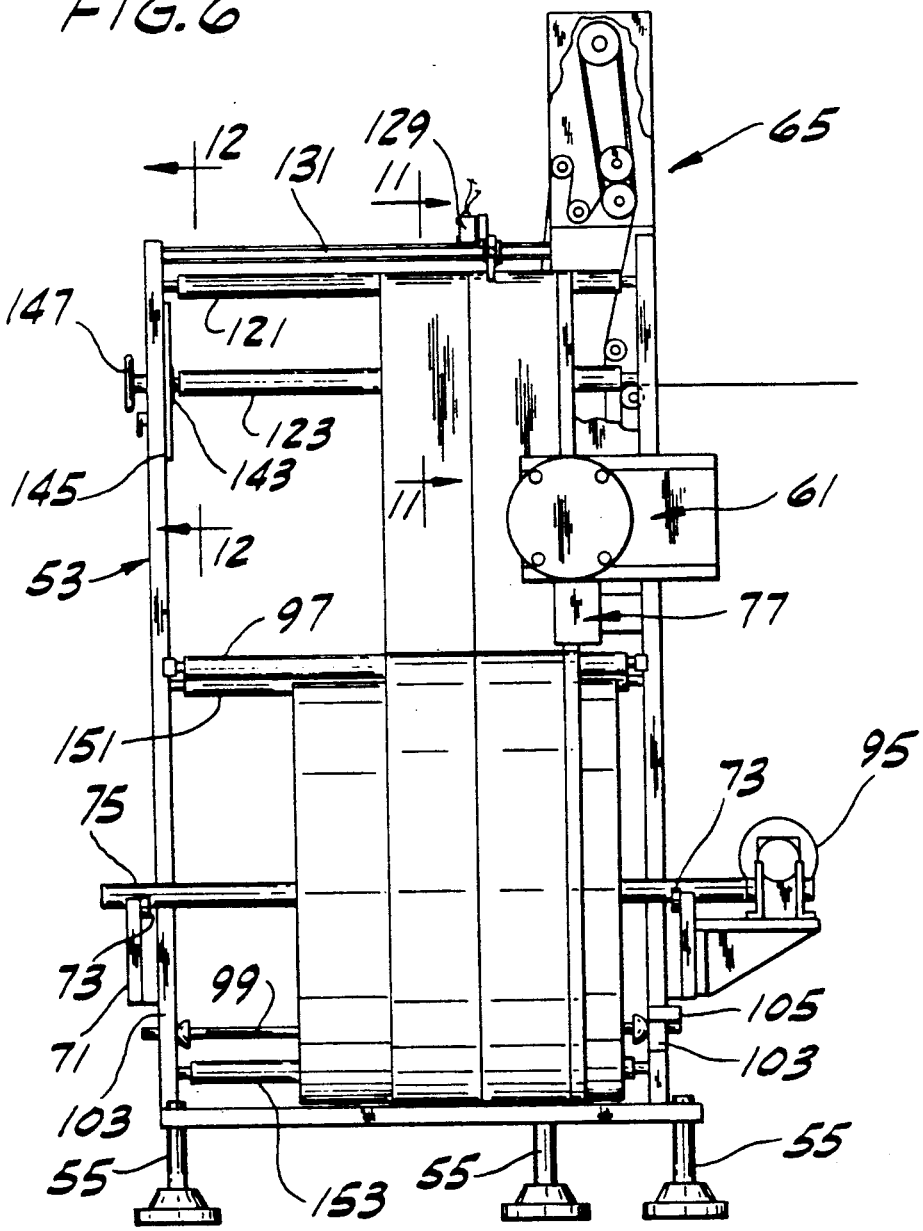
FIG. 6 is a right side elevation of the apparatus of FIG. 5.
Figure 7:
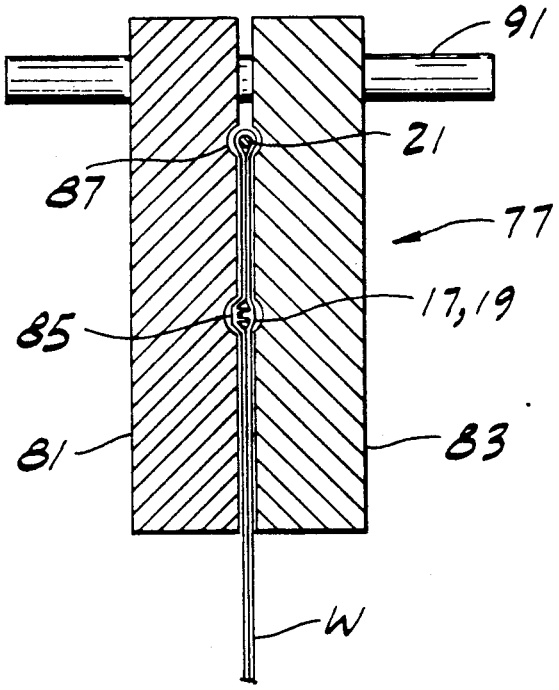
FIG. 7 is an enlarged horizontal section taken on line 7—7 of FIG. 1 showing a guide.

More particularly, means 57 for holding the supply roll R comprises a cradle structure 71 connected to the frame and having journals 73 for rotatably holding a shaft 75 on which the supply roll is mounted. Folded web is fed from the supply roll for travel to the press 61. Guide means, generally designated 77, immediately upstream from the press 61 engages the web in the area of the interlocked closure strips 17, 19 and cutting string 21 (if present) to guide the web into precise position for travel through the press. Such guiding is important since the side-to-side position of the web may vary as it approaches the press due to the fact that the winds of web on the supply roll R are typically staggered laterally relative to one another (see FIG. 6) to avoid undesireable build-up of the relatively thick closure strips 17, 19 atop one another. Guide means 77 comprises a pair of guide plates 81, 83 releasably held in face-to-face, spaced apart relation for receiving the folded web therebetween (FIG. 7). The opposing plates have two sets of grooves therein, one set defining a recess 85 extending in the direction of web travel for receiving the enfolded interlocked closure members 17, 19 therein and the other set defining a recess 87 extending in the direction of web travel for receiving the enfolded cutting string 21 (if used) therein. During operation of the apparatus the guide plates 81, 83 are spaced sufficiently close that the interlocked closure strips and cutting string are retained in their respective recesses to maintain the desired lateral web position yet sufficiently far apart to permit substantially uninhibited passage of the web between the plates. The separation of the guide plates is adjustable by means of an adjustment screw 91 threaded through the plates. The guide plates are mounted on the frame 53 so that web is precisely positioned in side-to-side direction as it enters the press 61.

To facilitate movement of the web through guide means 77, it is desireable to have the web substantially tension free as it approaches the guide means. This is accomplished by what what may generally be referred to as supply feed means for feeding folded web from the supply roll R at a rate sufficient to maintain the web in a substantially tension-free condition as it advances toward the guide means. This supply feed means comprises a motor 95 which rotates the shaft 75 on which the roll R is mounted, an accumulator roll 97 mounted in fixed horizontal position on the frame, and a lightweight dancer roll 99 mounted below the accumulator roll, the accumulator and dancer rolls 97, 99 defining a path of web travel to the guide means 77 which creates a surplus or accumulation of web. The dancer roll 99 has ends movable in vertical slots 101 in parallel upright frame members 103, the arrangement being such that the dancer roll is adapted to move upwardly as web intermittently advances through the apparatus thereby depleting the surplus of web created by the dancer roll. A sensor 105 (FIG. 6) of suitable design mounted on the frame 53 is responsive to such upward movement to energize the motor 95 to rotate the shaft 75 to feed additional web from the supply roll R until the surplus is replenished. This may be accomplished by running the motor for a predetermined interval of time sufficient to cause the dancer roll 99 to descend to its original position, after which interval the motor is deenergized. Alternatively, the motor may be deenergized in response to a signal indicating that the dancer roll has returned to its lowered position. In any event, this dancer roll arrangement ensures that a surplus of substantially tension-free web is maintained for travel to the guide means 77 and thence to the press 61. It is important in this regard that the dancer roll 99 be as light as possible.

Figure 8:
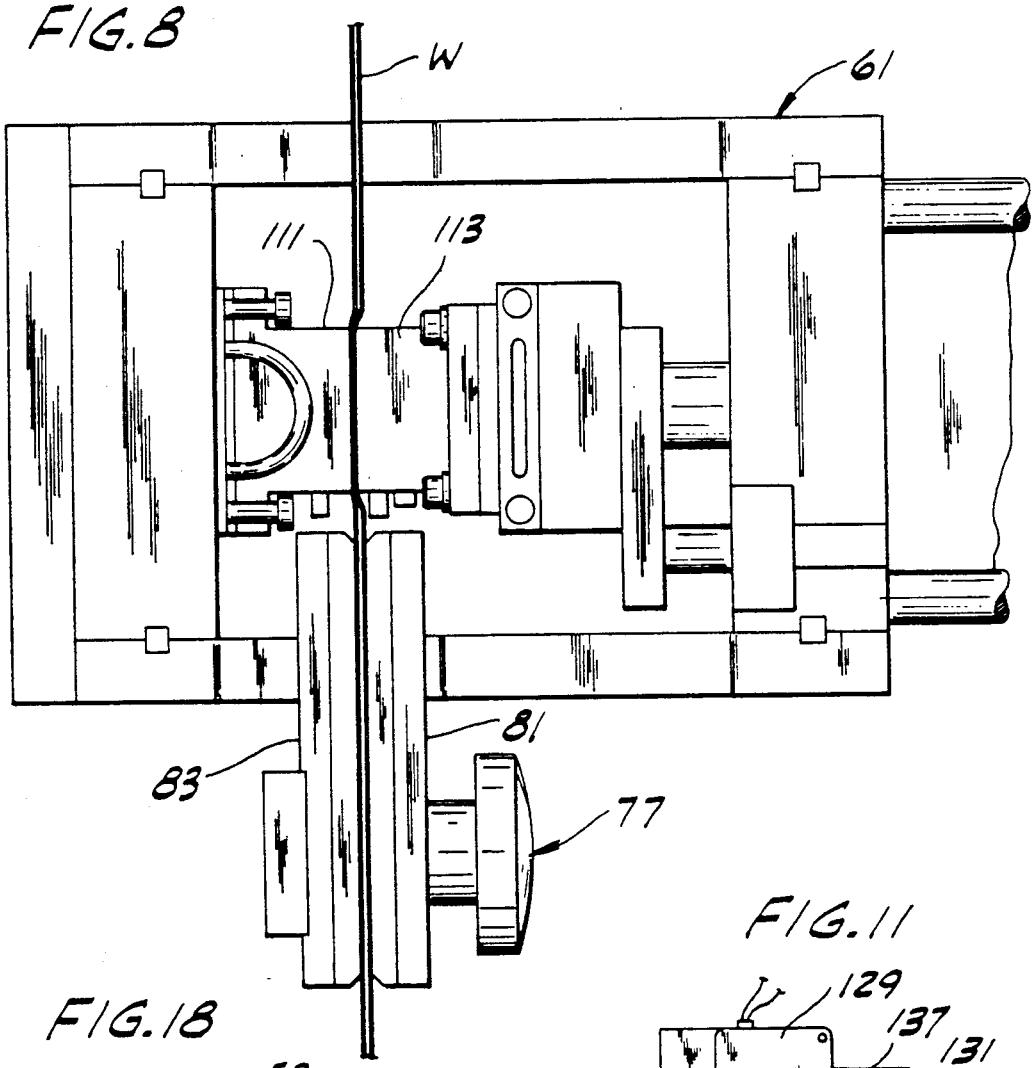
FIG. 8 is a front elevational view showing the guide and a press of the apparatus.
Figure 9:
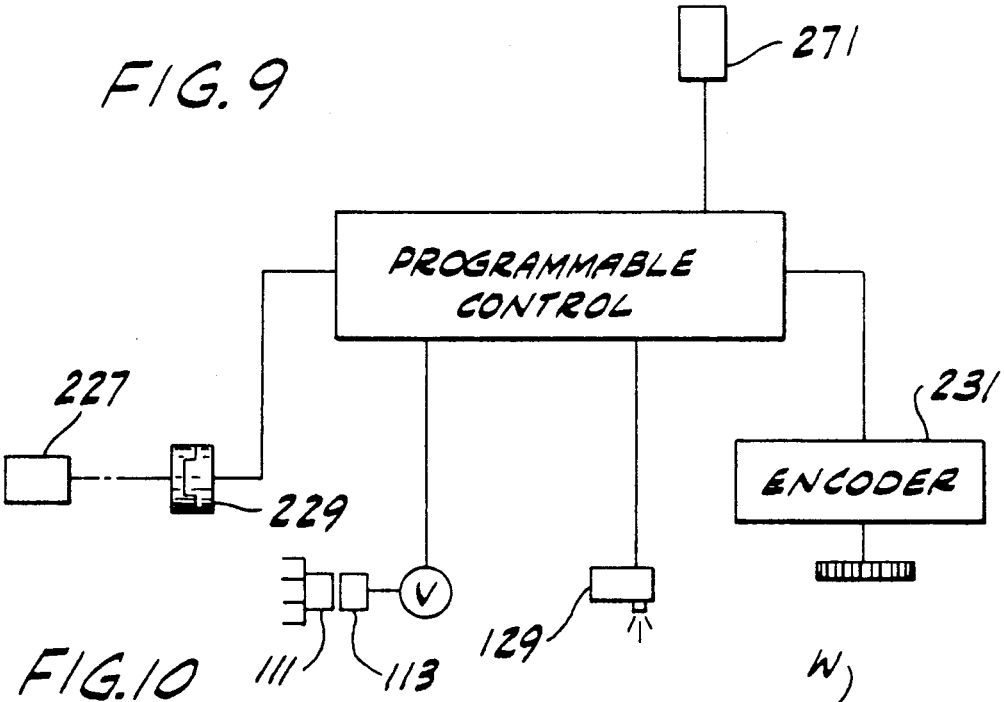
FIG. 9 is a schematic view of a programmable control and associated parts.

The press 61 is mounted on the frame upstream of the guide means 77 and comprises a pair of jaws, one of which (indicated at 111 in FIG. 8) is stationary and the other of which (113 in FIG. 8) is movable by appropriate pneumatics, for example, under the control of a valve V controlled by a programmable controller of the apparatus (FIG. 9). It will be understood, however, that both jaws 111, 113 could be movable without departing from the scope of this invention. Both jaws are preferably heated by suitable means to a temperature (e.g., 350° F.) sufficient to render the thermoplastic closure strips 17, 19 and cutting string 21 (if used) heat deformable. Jaw 113 is preferably movable from an open position to a partially closed (low pressure) position in which the heated jaws lightly engage the web in an area A including the closure strips 17, 19 and cutting string 21 to heat them, and then to a fully closed (high pressure) position for pressing the web in area A to flatten and pre-seal the closure strips and cutting string (if used) in areas corresponding to the end seals S of packages to be formed, the jaw 113 then moving back to its open position to enable the web to advance out of the press 61. By way of example, for film having a thickness of 0.075–0.080 in. in the area of the interlocked closure strips 17, 19 prior to flattening, the jaws 111, 113 may move to a partially closed position in which they have a separation of about 0.060 in., and to a fully closed position in which they flatten the film to a thickness of about 0.015–0.020 in. The time interval for which the jaws remain in their respective positions will vary depending on web speed and the type of film used, but the time interval for which the heated jaws remain in their partially closed position is preferably sufficient to plasticize the plastic closure strips 17, 19 and cutting string 21 (if present) so that they readily flatten when the jaws fully close, and so that the closure strips are thermally welded together in area A.

Figure 10:
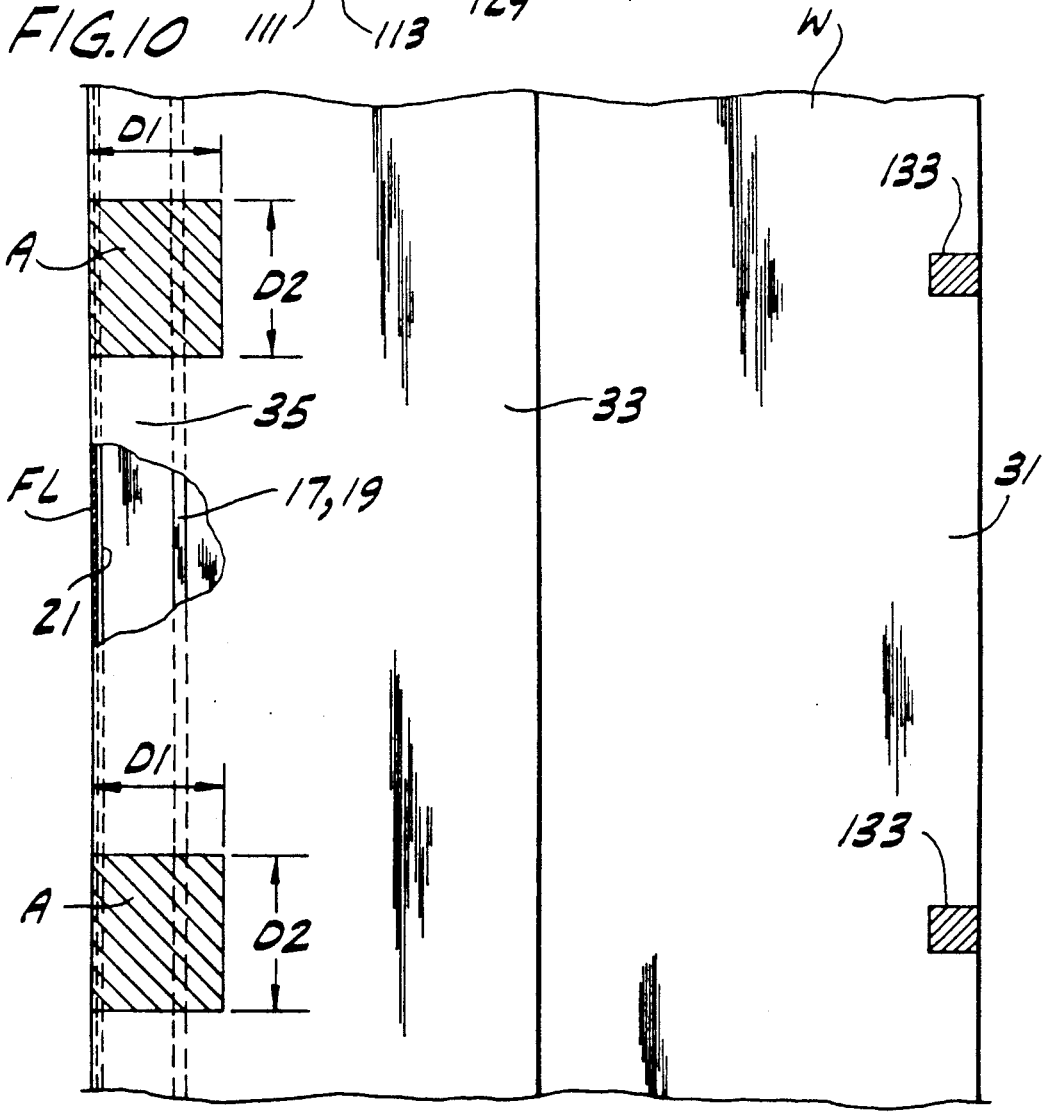
FIG. 10 is a plan view of folded web showing the size of the pre-seal areas effected by the jaws of the press.

As illustrated in FIG. 10, the jaws 111, 113 should be sized to engage an area A of the web having a dimension D1 greater than the width of the folded third section of the web to ensure flattening of the closure strips and the cutting string, if one is present, and a dimension D2 extending lengthwise of the web no greater than the width of the end seal area between adjacent packages to be formed (this end seal being sufficiently wide to form the trailing end seal S of one package and the leading end seal S of the next package when the packages are separated).

Figure 11:
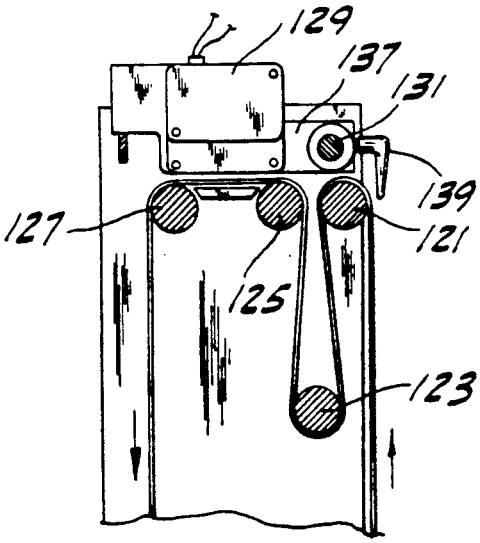
FIG. 11 is a vertical section taken on line 11—11 of FIG. 6.
Figure 12:
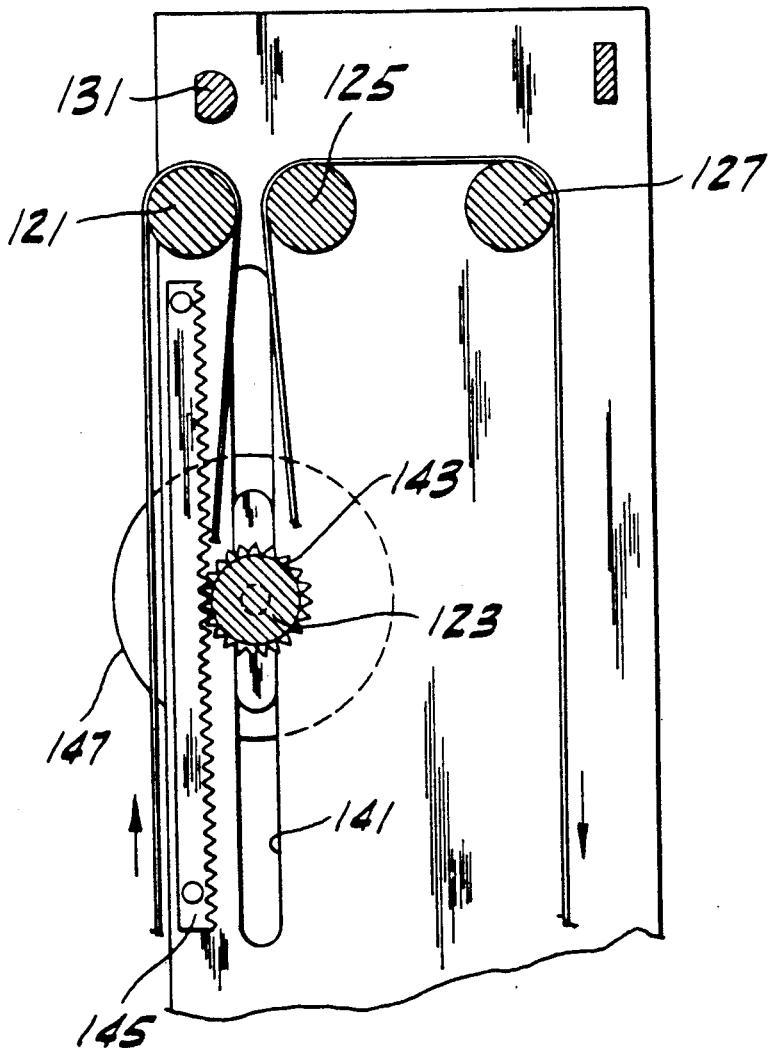
FIG. 12 is an enlarged vertical section taken on line 12—12 of FIG. 6.

After exiting the press 61, a pre-sealed web W advances intermittently up to a cluster of four horizontal rolls indicated at 121, 123, 125, 127, three of the rolls lying in the same generally horizontal plane and the fourth (123) being disposed at a lower level. As shown in FIG. 11, a detecting device such as an optical scanner 129 is mounted on a slide rod 131 on the frame 53 for detecting package-interval registration marks 133 ("eye-spots") on preprinted web as it passes from roll 125 to roll 127, and for sending a suitable signal to the programmable controller to time the opening and closing of the jaws 111, 113 according to the detection of such marks. The optical scanner 129 is mounted on a bracket 137 slidable along the slide rod 131 to selected positions of adjustment appropriate for the width of the web being used and the position of the registration marks 133 on the web. The scanner may be locked in a selected position of adjustment by a locking device 139. The lower roll 123 of the cluster, which may be referred to as a registration roll, is vertically adjustable relative to the main frame 53 so that the jaws 111, 113 close at the proper location on the web (that is, in the areas A corresponding to the end seals S of the packages) when a registration mark 133 is detected by the scanner 129. To provide for such vertical adjustment, the ends of the registration roll 123 are movable up and down in vertical slots 141 in the frame (FIG. 12). The roll 123 carries a pinion 143 engageable with a vertical rack 145 on the frame, and a handle 147 is provided for turning the pinion to adjust the vertical position of the roll. The registration roll 123 may be releasably locked in adjusted position by any suitable means.

From the aforementioned cluster of rolls the web travels down past an idler roll 151 to a roll 153 which directs the folded and pre-sealed web for travel in a generally horizontal (first) plane adjacent the bottom of the frame 53 to the web-opening means 63, which comprises a spreader in the form of a V-shaped member 157 having a tip 159 and left and right sides 161, 163, respectively, (as viewed in FIGS. 1 and 13) diverging from the tip. The spreader 157 is mounted on a subframe 165 and lies in a vertical plane generally at right angles to the horizontal plane of the web and generally parallel to the direction of travel of the folded web as it approaches the web-opening station 43. The spreader is formed to spread open or unfold the aforementioned first 31 and second 33 sections of the web, while maintaining the closure strips 17, 19 interlocked (and the third web section 35 folded), by diverting the first section 31 of the web to lie in plane (i.e., the vertical plane of the spreader 157) different from the horizontal plane of the web as it approaches the web-opening station, and by diverting the second section 33 of the web to lie in the same plane (i.e., the plane of the spreader) so that the two sections are co-planar and spread open relative to one another, the closure strips 17, 19 remaining interlocked so that the folded third section 35 of the web remains folded and extends like a fin generally at right angles to the plane of the first and second web sections 31, 33 and to the plane of the spreader 157 (see FIG. 15).

In addition to so diverting the first (31) and second (33) sections of the web, the web-opening means 63 depicted in the embodiment shown in the drawings also bends the web 90° about an axis extending generally transversely of the web as it approaches the spreader 157 so that the direction of travel of the web as it exits the web-opening station 43 is at right angles to the direction of web travel as it approaches the web-opening station. It will be understood, however, that this latter 90° rotation may be omitted without departing from the scope of this invention.

To ensure that the folded web W approaching the spreader 157 is guided to the correct location relative to the spreader, first guide means is provided comprising a guide roller 171 disposed immediately upstream from the tip 159 of the spreader and a guide indicated generally at 173 upstream from the guide roller. This latter guide 173 is essentially identical in function to guide means 77 upstream from the press 61, comprising upper and lower guide members 175, 177 affixed to the spreader subframe 165 and having two sets of mating grooves forming horizontal recesses 181, 183 for receiving the enfolded and interlocked closure strips 17, 19 and cutting string 21, if used; (See FIG. 14). Web exiting this guide 173 advances to the guide roller 171 which is mounted on the spreader subframe 165 to extend transversely with respect to the web. The roller 171 has a wide circumferential channel 185 therein for receiving the folded fin-like third section 35 of the web as the web passes the roller. This channel 185 is positioned for directing the folded web W to the tip 159 of the spreader 157 so that the tip engages the web at a point closely adjacent the interlocked closure strips 17, 19, the result being that the first and second sections 31, 33 of the web are diverted to opposite diverging sides 161, 163 of the spreader and thus spread open. The spreader is preferably made of circular section metal rod welded together and formed into a V-shape, with the tip of the V being sufficiently blunt to avoid damage to the web as the web engages the tip and is spread open by the spreader.

Figure 13:
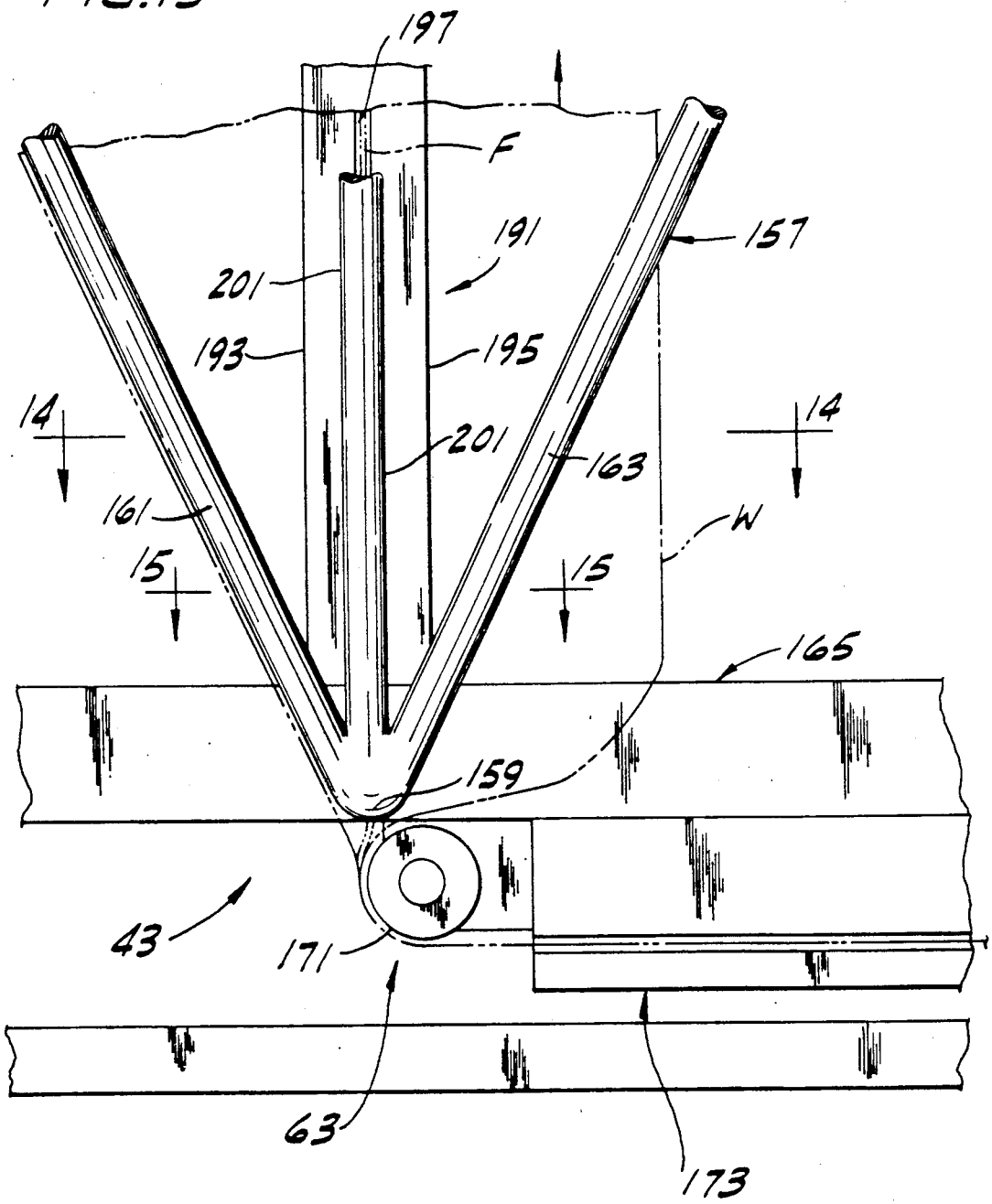
FIG. 13 is an enlarged front elevation of web-opening means of the apparatus.
Figure 14:
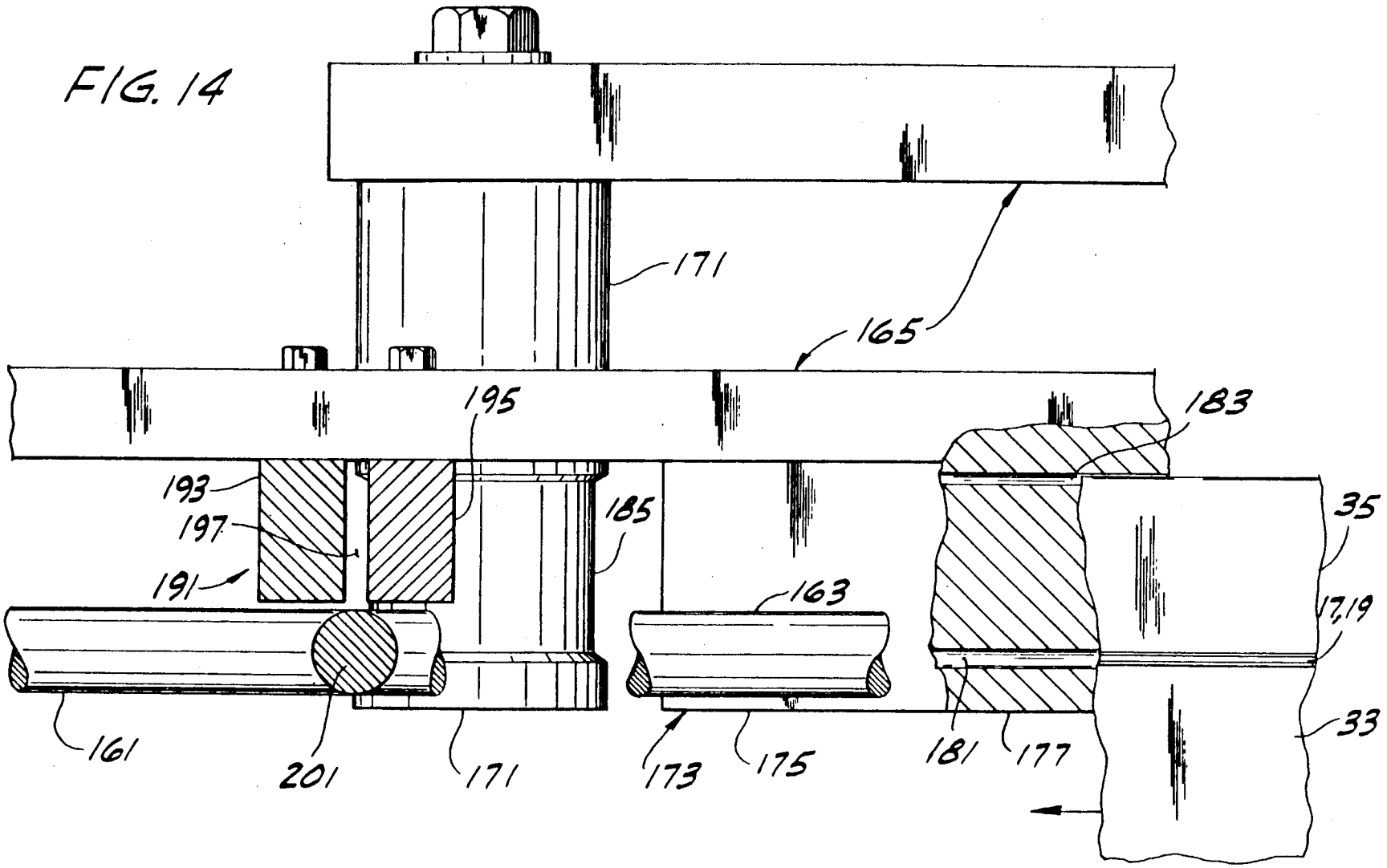
FIG. 14 is a horizontal section on line 14—14 of FIG. 13, parts being broken away for clarity.
Figure 15:
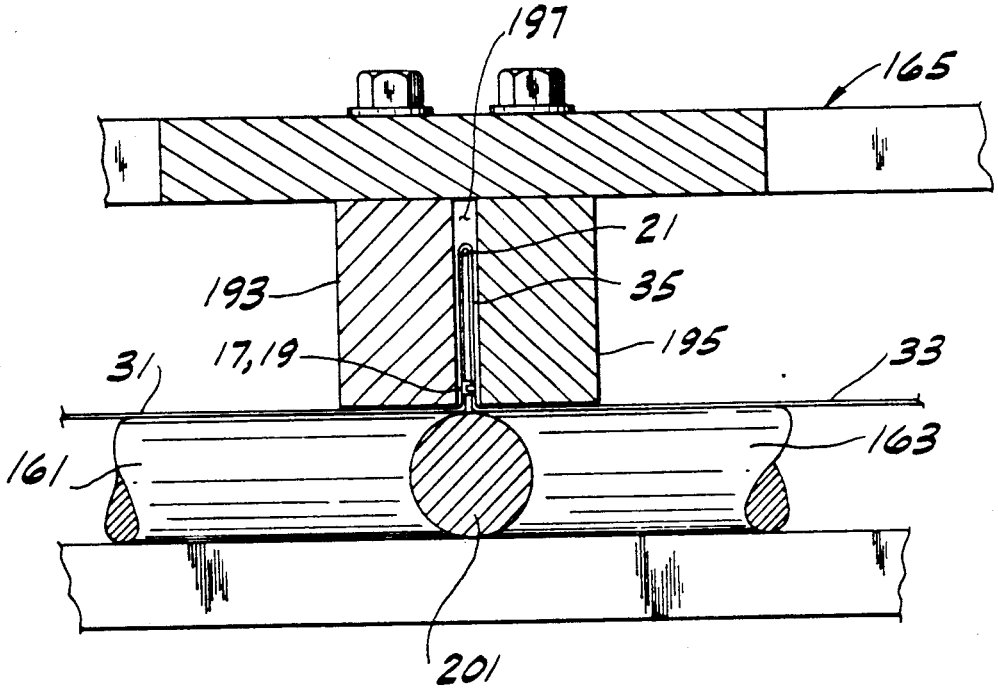
FIG. 15 is a horizontal section on line 15—15 of FIG. 13.

Indicated generally at 191 in FIGS. 13–15 is additional guide means defining a path of travel for the opened web as it moves upstream from the tip 159 of the spreader. More specifically, this means 191 comprises a pair of side-by-side guide members 193, 195 defining a narrow vertical guideway 197 therebetween extending upwardly from adjacent the tip 159 of the spreader generally at right angles to the plane of the spreader, and a vertical guide rod 201 extending up from the tip of the spreader in the plane of the spreader and positioned adjacent the mouth of the guideway 197. As shown in FIG. 15, web moving upwardly from the tip of the spreader is disposed between the guide rod 201 and the two guide members 193, 195 with the fin-like third section 35 of the web being received in the guideway 197 to ensure proper lateral positioning of the web as it advances to the web feeding and measuring means 65. It will be noted in this regard that the channel 185 in the guide roller 171 is generally laterally aligned with the guideway 197 so that the guideway receives the fin-like third web section 35 shortly after exiting the channel in the roller guide. The vertical guide members 193, 195 are suitably fastened to the subframe 165, as shown in FIG. 14. The guide rod 201 is affixed (e.g., welded) at its lower end to the tip 159 of the spreader 157 and is also attached at its upper end to the subframe.

Figure 16:
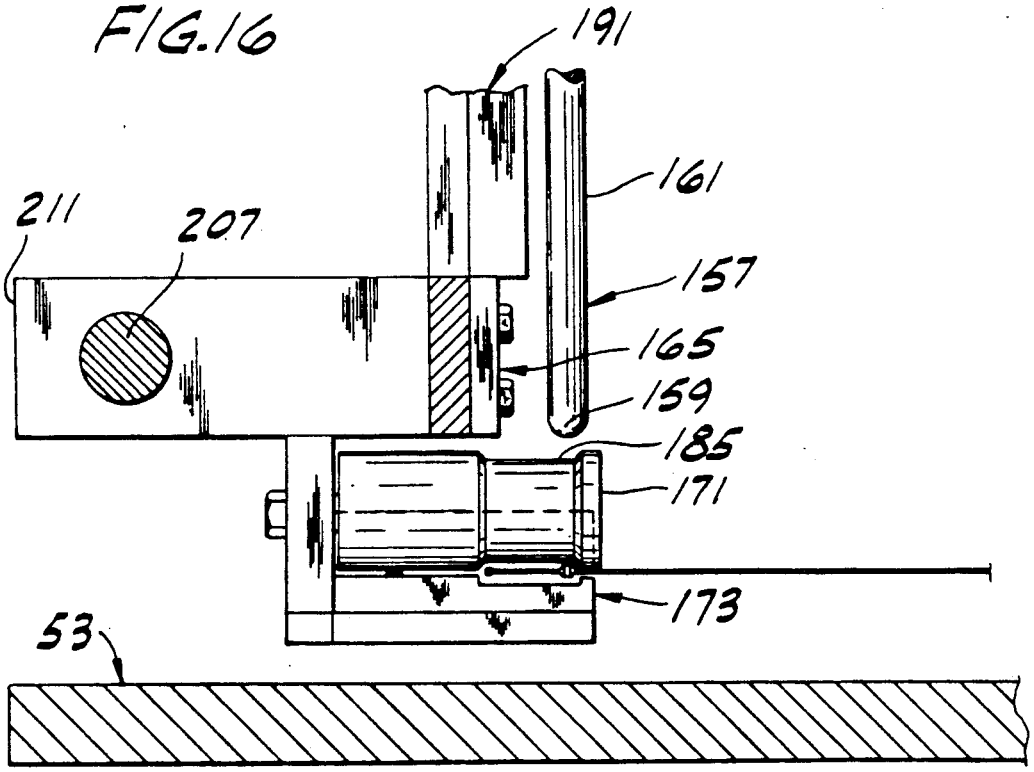
FIG. 16 is an enlarged vertical section taken on line 16—16 of FIG. 5.
Figure 17:
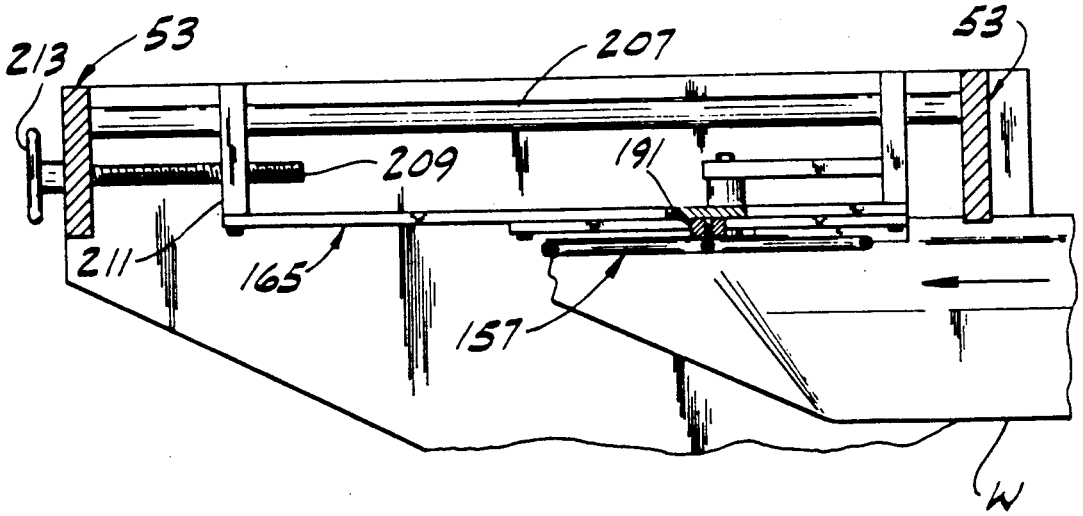
FIG. 17 is a horizontal section taken on line 17—17 of FIG. 5.

The spreader subframe 165 is slidable on upper and lower horizontal slide rods 205, 207 affixed to the main frame 53, as shown in FIGS. 1, 16 and 17. The arrangement is such that the spreader 157 is movable in the plane of the spreader to adjust the lateral position of the opened web to correspond with the input of downstream package-forming apparatus. Adjustment of the subframe 165 carrying the spreader is effected by means of a screw shaft 209 rotatably mounted on the main frame and threaded through a nut 211 attached to the subframe 165, and by a handle 213 on the shaft 209 for turning the screw shaft to effect adjustment in either direction axially of the slide rods 205, 207. The guide 173, the roller guide 171, and the vertical guide members 193, 195 are mounted on the subframe 165 for conjoint movement with the spreader 157 so that these parts remain in fixed position relative to one another.

Figure 18:
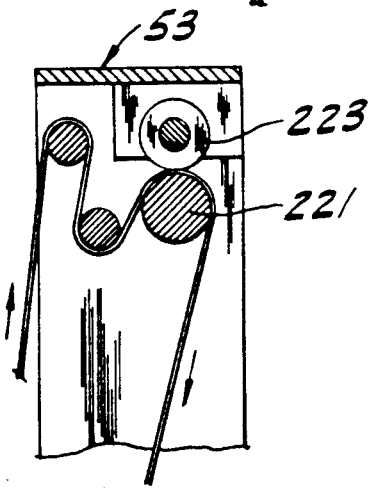
FIG. 18 is a vertical section taken on line 18—18 of FIG. 5 showing web feeding and measuring means of the apparatus.
Figure 19:
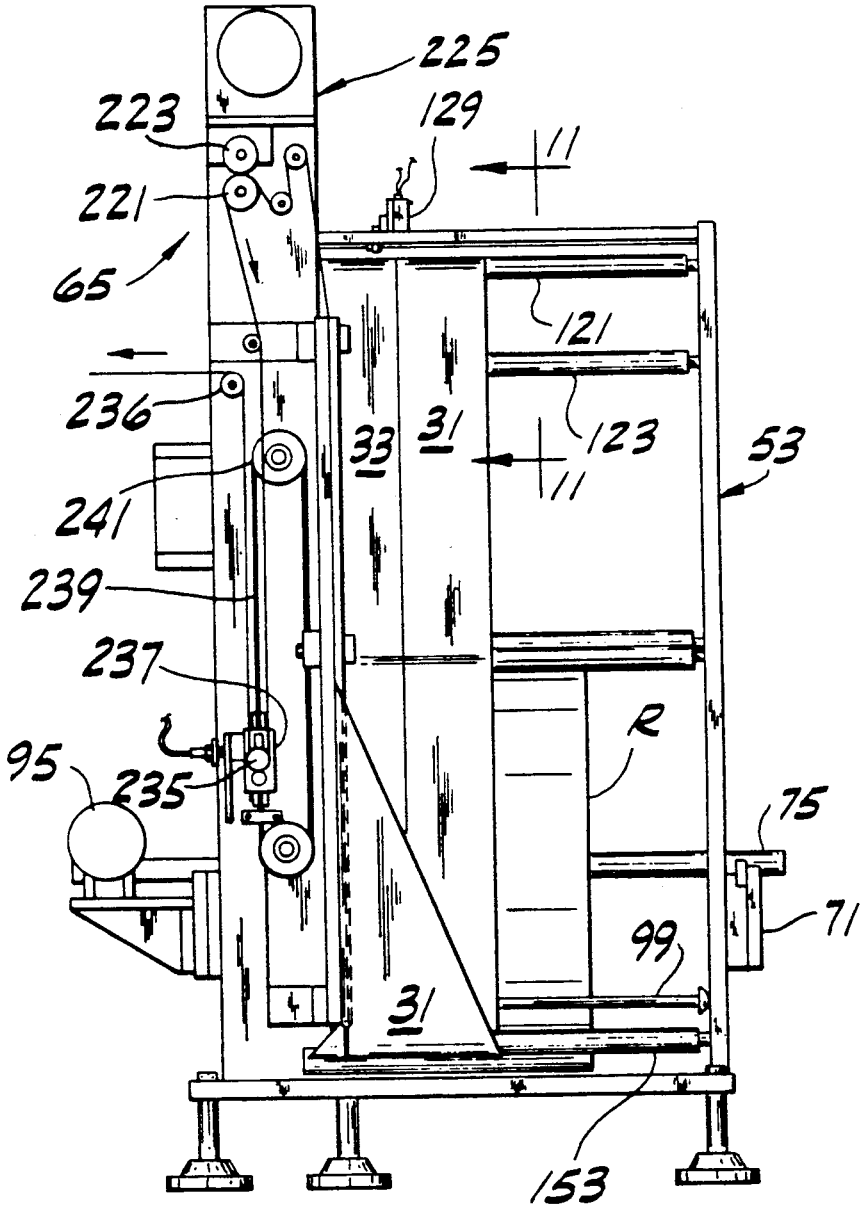
FIG. 19 is a vertical section taken on line 19—19 of FIG. 5.

The web feeding and measuring means 65 may be similar to the web feeding and measuring (or metering) means disclosed in U.S. Pat. No. 4,288,965, issued Sept. 15, 1981 (Reexamination Certificate B1 4,288,965) to Hayssen Manufacturing Company of Sheboygan, Wis. Thus the web feeding and measuring means 65 comprises a lower roll 221 and an upper roll 223 with means indicated generally at 225 for intermittently driving these rolls through a predetermined interval corresponding to the desired length for the packages to be formed to feed the web forward one such increment (see FIGS. 18 and 19). This driving means 225 may be a continuously operating electric motor/speed reducer unit 227 driving the input of an electric clutch/brake unit 229 (see FIG. 9), as described in detail in U.S. Pat. No. 4,288,965, the clutch of unit 229 being adapted to be intermittently engaged and the brake of unit 229 disengaged for driving the rolls 221, 223 to feed forward the requisite package-length increment of web on each feed cycle by the programmable controller under the control of an encoder 231, the clutch being disengaged and the brake engaged to terminate the feed cycle and remaining so for the dwell of the web, the clutch then being engaged and the brake disengaged for the next feed cycle.

Figure 20:
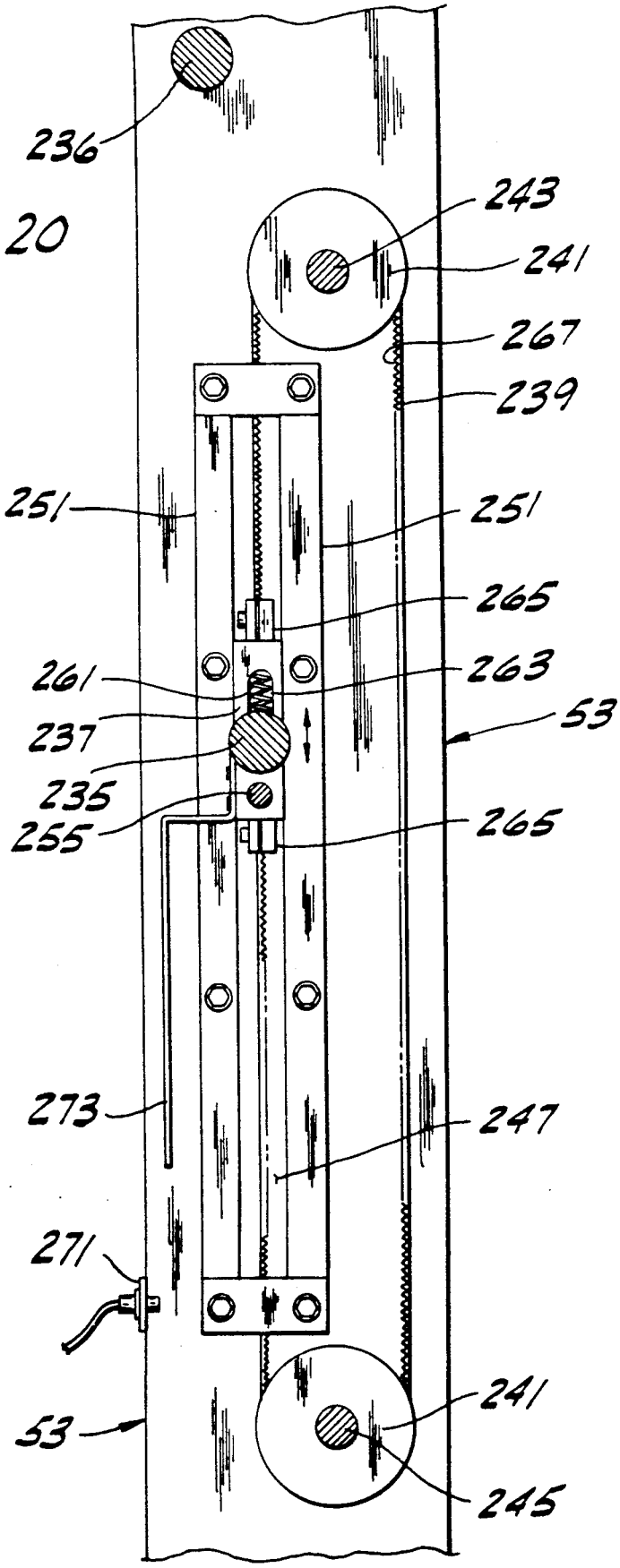
FIG. 20 is an enlarged vertical section on line 20—20 of FIG. 5.

Horizontal dancer and exit rolls indicated at 235 and 236, respectively, are mounted on the frame 53 downstream from the web feeding and measuring means 65 and define a path of web travel which creates a surplus or accumulation of web to permit the web to be fed from the apparatus continuously even though the web feeding and measuring means 65 operates intermittently. The dancer roll 235 is located a substantial distance below the web feed and measuring rolls 221, 223 and is movable vertically relative to the frame 53, the roll 235 moving upwardly as the surplus is depleted on account of continuous feed from the apparatus during a dwell of the web feeding and measuring rolls, and moving down during a feeding cycle of the web feeding and measuring rolls (the web feeding and measuring rolls feeding at a speed faster than the speed at which the web exits the apparatus so as not to entirely deplete the surplus). Unlike the upstream dancer roll 99 previously described, which need not remain horizontal as it moves up and down, it is important that the downstream dancer roll 235 remain precisely horizontal as it "dances" to insure that the web tracks properly and exits the machine at the desired position and in the desired direction. To accomplish this, the ends of the dancer roll 235 are carried by two carriages, each designated 237, mounted on belts 239 trained around pulleys 241 (two per belt) mounted on upper and lower horizontal shafts 243, 245 journalled in the frame 53 of the machine. As shown in FIG. 20, the carriages 237 are movable conjointly with the belts 239 in vertical guideways 247 defined by guide bars 251 fastened to the frame 53. To further stabilize the carriages 237, they are connected by a stabilizing bar 255 extending immediately below and generally parallel to the dancer roll 235. Because all four pulleys 241 are tied together by the belts 239 and the shafts 243, 245, movement of one belt and carriage causes an exactly corresponding movement of the other belt and carriage, so that the dancer roll 235 remains precisely horizontal as it moves up and down (the carriages, belts, pulleys and shafts thus constituting means for maintaining the dancer roll horizontal as it moves). A rack and pinion mechanism could be used in lieu of the pulley-shaft arrangement described. Springs 261 mounted in recesses 263 in the carriages 237 are compressible as the dancer roll moves up to cushion against any sudden jarring or jerky movement. Web advances from the dancer roll 235 up to the exit roll 236, which directs web along a horizontal path for exit from the apparatus.

To ensure that the carriages 237 do not slip relative to their respective belts 239, suitable clamps 265 on each carriage clamp against teeth 265 on the belts (see FIG. 20).

A sensor 271 (e.g., a proximity sensor) is mounted on the main frame 53 for sensing a predetermined upward movement of the dancer roll 235 (or a part movable with the dancer roll, such as a bar 273 depending from carriage 239) indicating a predetermined depletion of the surplus web accumulated by the dancer and exit rolls 235, 236. Upon sensing such movement, the sensor is adapted to signal for the intermittent feed of additional web by the web feeding and measuring rolls 221, 223. Such intermittent feed continues until the sensor 271 detects that the dancer roll 235 has returned to a predetermined level, at which time the sensor signals to stop further feed of web by the web feed and measuring rolls.

Operation

In the operation of apparatus 51 in accordance with the method of the present invention, the motor/speed reducer unit 227 is operated continuously. If there is a demand for web from the apparatus of this invention, as indicated by a signal from sensor 271 associated with the downstream dancer roll 235, the clutch/brake unit 229 is acutated (i.e., its clutch engaged, its brake disengaged) at timed intervals to intermittently feed web forward in package-length increments. The timing of the intervals is determined by means of the optical scanner 129 operating in conjuction with the registration marks 133 on the web in the case of preprinted web, or by the encoder 231 measuring rotation of the web feed and measuring rolls 221, 223 in the case of unprinted web.

At the beginning of a feed cycle (i.e., when the clutch/brake unit 229 is actuated), the jaws 111, 113 of the press 61 are open and web is pulled from the surplus of substantially tension-free web accumulated by the upstream dancer roll 99. This web passes substantially tension free through the guide 77 and thence to the jaws, the guide serving to guide the web into precise position relative to the jaws. As web W is pulled, the surplus of web created by the dancer roll 99 is depleted, thereby causing the dancer roll to rise. This is detected by sensor 105 which signals for the energization of motor 95 to rotate the shaft 75 of the supply roll R to feed more web (in folded condition) from the roll until the surplus is replenished, as determined for example by the termination of a predetermined time interval.

After the web feed and measuring rolls 221, 223 have fed forward a package-length of web, as detected by the optical scanner 129 in conjunction with the registration marks 133 on the web (in the case of preprinted web), or as measured by the encoder 231 in the case of unprinted web, the clutch/brake unit 229 is deactuated to cause a dwell of the web. At this time the programmable controller signals for the acutation of valve V to move the jaws 111, 113 from their open position to a partially closed position in which the jaws lightly engage the closure strips 17, 19 and the cutting string 21 (if present) to heat these thermosplastic elements for an interval of time sufficient to soften them, after which the jaws close to their stated fully closed position to flatten and pre-seal the web in an area A (see FIG. 10) corresponding to the end seals S of two packages P (the trailing seal of one package and the leading seal of the next package to be formed). This "pre-seal" step is important because it allows the end seals S to be formed at lower sealing jaw pressures, and because it increases the integrity and strength of the end seals of the packages to be formed. The jaws 111, 113 open after an interval of time sufficient to effect the aforementioned heating, pressing and flattening of the closure strips and cutting string, after which time another feed cycle begins (assuming there is still a demand for web downstream from the apparatus).

Figure 21:
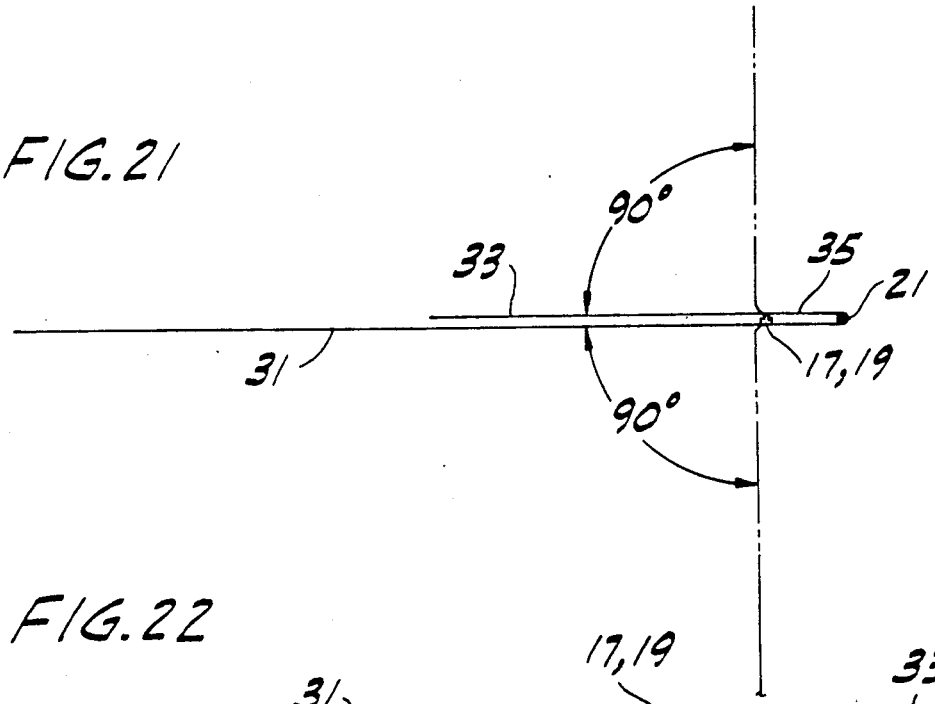
FIG. 21 is a view showing how a web in folded condition is opened or unfolded in accordance with the method of this invention.
Figure 22:
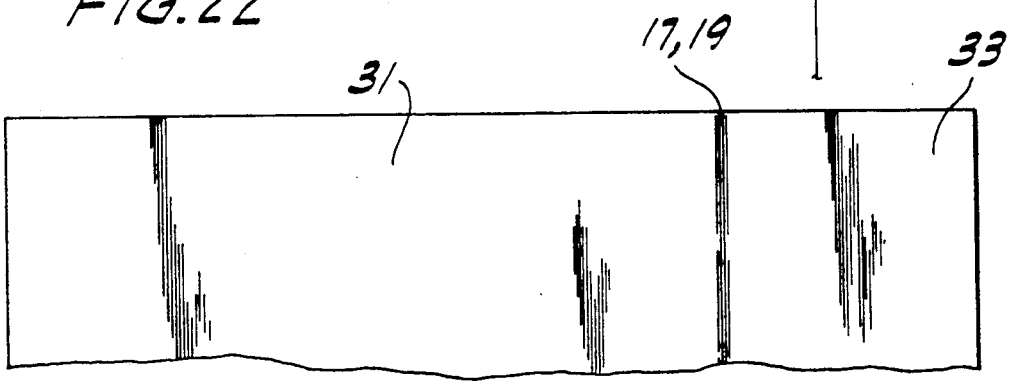
FIG. 22 is a view of the opened web of FIG. 21.
Figure 23:
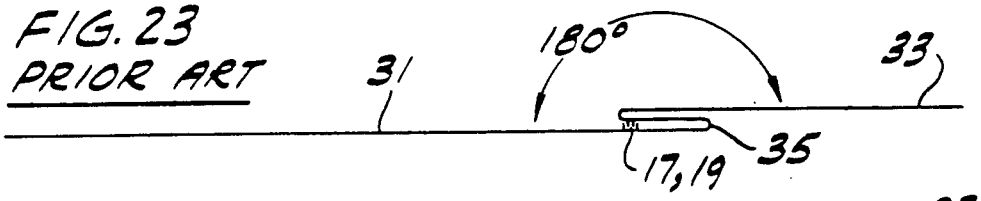
FIG. 23 PRIOR ART
FIG. 23 is a view illustrating how a web in folded condition is opened or unfolded in accordance with prior art methods.
Figure 24:
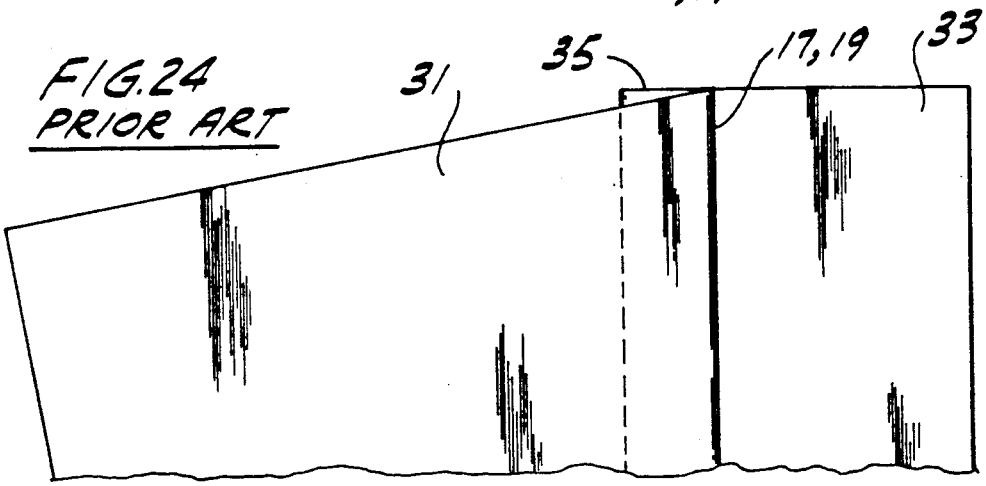
FIG. 24 PRIOR ART
FIG. 24 is a view of the opened web shown in FIG. 23.

As package-length increments of web are intermittently fed forward by the web feeding and measuring rolls 221, 223, folded web from the press 61 advances to the web-opening station 43, where it passes first through guide 173 and then beneath the guide roller 171 from which it is directed to the tip 159 of the spreader 157. As the web moves past the tip, the spreader spreads open the first and second sections 31, 33 of web relative to one another by diverting these sections into engagement with respective diverging legs 161, 163 of the spreader. This diversion involves pivoting of both sections in opposite directions approximately 90° about a horizontal axis corresponding to the interlocked closure strips 17, 19, as shown in FIGS. 21 and 22, with the sections thus being disposed in a plane different from the one in which they approached the spreader. This method is to be contrasted to prior methods where the folded web is opened by unfolding one section 180° relative to the other section. As illustrated in FIGS. 23 and 24, the prior opening method results in uneven tensioning of the film as it is opened and pulled forward, making proper tracking of the film difficult and causing other problems. The present method overcomes these difficulties by diverting both sections 31, 33 substantially the same extent so that the sections are not skewed relative to one another and thus are equally tensioned as they are pulled through the apparatus, which greatly facilitates accurate tracking of the film (FIG. 22). The guide members 193, 195 and guide rod 201 upstream of the tip 159 of the spreader 157 ensure accurate positioning and tracking of the web past the spreader and toward the web feed and measuring rolls 221, 223.

The operation of the clutch/brake unit 229 continues until such time as the downstream dancer roll 235 returns to a position in which the web surplus downstream from the feed and measuring rolls 221, 223 is replenished (indicating a cessation or diminishment of downstream demand for web), at which time the programmable controller signals to stop further actuation of the feed and measuring rolls.

The principles of this invention are regarded as applicable to method and apparatus for unfolding a web without pre-sealing it. In such case, the programmable controller may be programmed to maintain the jaws 111, 113 open, and to operate the web feed and measuring rolls 221, 223 continuously to feed web continuously past the spreader 157 to open the web. Conversely, the principles of this invention are regarded as also being applicable to method and apparatus for pre-sealing the web in the manner described without unfolding it (unfolding being separately accomplished).

It is contemplated that the spreader 157 described above may have other configurations so long as the intended function is achieved, namely, spreading the first and second sections 31, 33 of the web W open by opening both sections relative to each other so that the opened sections are disposed in a plane different from the plane of the folded web.

Figure 25:
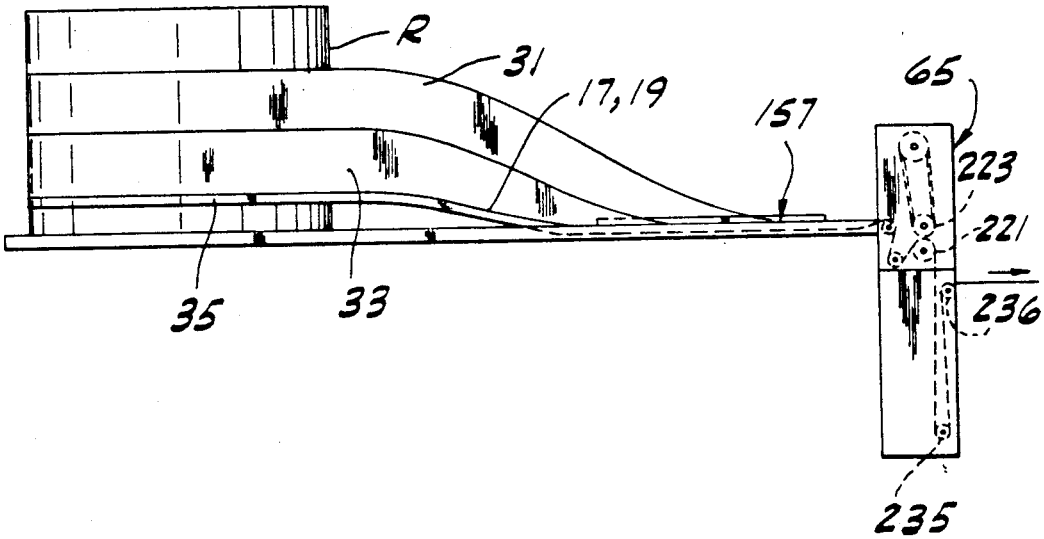
FIG. 25 is a shematical side elevational view depicting method of and apparatus for opening a folded web of packaging material, the material being fed from a supply roll mounted with its axis of rotation vertical instead of horizontal.
Figure 26:
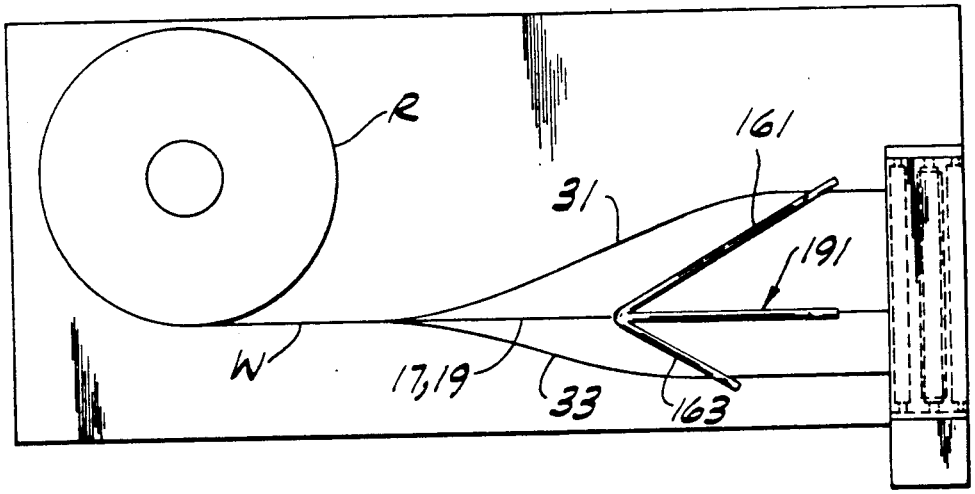
FIG. 26 is a top plan view of FIG. 25.

While the supply roll is depicted in FIG. 1 as being unwound on a generally horizontal axis, it is contemplated that the supply roll may also be unwound on a vertical axis. Method and apparatus for accomplishing this is schematically depicted in FIGS. 25 and 26, where parts corresponding to those described in the first embodiment are designated by the same reference numerals. As shown, the supply roll R is mounted with its axis of rotation vertical. Folded web W is fed forward from the roll and guided by appropriate means to a V-shaped spreader 157 (web-opening means) disposed in a horizontal (instead of a vertical) plane. As shown, the spreader 157 is engageable with the web to spread the web sections 31, 35 open, each section being diverted relative to the other by engaging a respective leg 161, 163 of the spreader until the two sections lie in the same horizontal plane as the spreader. The closure strips 17, 19 remain interlocked, with the fin-like third section 35 of the web projecting down for reception in a guideway (not shown) of guide means 191. This guide means 191 serves to guide the web to the web feeding and measuring means, indicated generally at 65, which feeds the web forward to dancer roll 235 and then to exit roll 236. While a pre-seal step is not shown in FIGS. 25 and 26, it will be understood that it may be incorporated.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A method of opening a folded web of flexible heat-sealable packaging material prior to formation of the material into sealed reclosable packages, said web having generally parallel side edges extending longitudinally of the web, and a pair of interlocking reclosable closure strips extending longitudinally of the web on an inside face of the web, said closure strips dividing the web into a plurality of sections extending longitudinally of the web, including a first section extending between one side edge of the web and one closure strip and a second section extending between the other closure strip and the other side edge of the web, said web being folded along a fold line extending between and generally parallel to said closure strips so that said second section of the web is folded over with its inside face flat against the inside face of the first section of the web and so that the closure strips are interlocked, said method comprising advancing the folded web, with the first and second sections of the web disposed in a first plane and the closure strips interlocked, to a web-opening station, and opening the folded web while maintaining the closure strips interlocked as the web advances through the web-opening station by diverting said first section of the web out of said first plane to lie in a second plane different from said first plane, and by diverting said second section of the web out of said first plane to a lie in said second plane so that said first and second sections of the web are co-planar in said second plane and unfolded relative to one another, said closure strips remaining interlocked as said first and second sections are diverted.

2. A method as set forth in claim 1 wherein said second plane is disposed generally at right angles to said first plane.

3. A method as set forth in claim 2 wherein diverting said first and second web sections involves bending the web approximately 90° as it is opened so that the opened web advances from the web-opening station in a direction generally at right angles to the direction of advancement of the folded web to the web-opening station.

4. A method as set forth in claim 1 further comprising flattening said closure strips at package-length intervals prior to opening the folded web.

5. A method as set forth in claim 4 wherein said closure strips are of plastic and said flattening step comprises heating the closure strips to render them heat deformable, and then pressing the closure strips to flatten them.

6. A method as set forth in claim 5 wherein said heating and pressing of the closure strips thermally welds the strips together at package-length intervals.

7. A method as set forth in claim 1 further comprising feeding folded web from a supply of folded web for travel to a pressing station, intermittently advancing the folded web through said pressing station in package-length increments, with a dwell between successive advances of the web, and heating and pressing said interlocked closure strips during each dwell.

8. A method as set forth in claim 7 wherein folded web is fed from said supply at a rate sufficient to maintain the web in a substantially tension-free condition as it enters the pressing station.

9. Apparatus for opening a folded web of flexible heat-sealable packaging material prior to formation of the material into sealed reclosable packages, said web having generally parallel side edges extending longitudinally of the web, and a pair of interlocking reclosable closure strips extending longitudinally of the web on an inside face of the web, said closure strips dividing the web into a plurality of sections extending longitudinally of the web, including a first section extending between one side edge of the web and one closure strip and a second section extending between the other closure strip and the other side edge of the web, said web being folded along a fold line extending between and generally parallel to said closure strips so that said second section of the web is folded over with its inside face flat against the inside face of the first section of the web and so that the closure strips are interlocked, said apparatus comprising means for holding a supply of folded web for travel of folded web fed from the supply along a predetermined path through the apparatus, a web-opening station adjacent said path, folded web approaching said station being disposed in a first plane, web-opening means for opening the folded web while maintaining the closure strips interlocked as the web advances past the web-opening station, said web-opening means being engageable with the folded web to divert said first section of the web out of said first plane to lie in a second plane different from said first plane, and to divert said second section of the web out of said first plane to a lie in said second plane so that said first and second sections of the web are co-planar in said second plane and unfolded relative to one another, said closure strips remaining interlocked as said first and second sections of the web are diverted from said first plane to said second plane.

10. Apparatus as set forth in claim 9 further comprising a frame, and means mounting said web-opening means on the frame for movement relative to the frame in a plane parallel to said second plane thereby to adjust the lateral position of the opened web advancing from the web-opening station.

11. Apparatus as set forth in claim 9 wherein said web-opening means comprises a spreader having diverging sides lying in a plane generally parallel to said second plane, said first and second sections of the folded web being engageable with respective diverging sides to spread open the web.

12. Apparatus as set forth in claim 11 wherein said spreader comprises a generally V-shaped member having a tip and sides diverging from the tip, said V-shaped member being disposed in a plane generally at right angles to said first plane and generally parallel to the direction of travel of the folded web as it approaches said web-opening station.

13. Apparatus as set forth in claim 12 further comprising first guide means upstream of the tip of said V-shaped member engageable with the web in an area including the interlocked closure strips to guide the folded web for travel toward the tip of said V-shaped member so that the tip separates and spreads said first and second sections of the web and diverts them to respective diverging sides of said V-shaped member.

14. Apparatus as set forth in claim 13 wherein said first guide means comprises a guide roller immediately upstream from the tip of said V-shaped member, said guide roller having a longitudinal axis disposed transversely with respect to the folded web, and a circumferential channel in the guide roller for receiving therein a folded third section of the web extending between the closure strips as the web passes the roller to the V-shaped tip.

15. Apparatus as set forth in claim 14 further comprising second guide means downstream from the tip of the spreader engageable with the web in the area of the closure strips and said third section of the web for guiding the web away from the tip.

16. Apparatus as set forth in claim 15 wherein said second guide means comprises a pair of guide members defining a relatively narrow guideway extending downstream with respect to the direction of web travel from a location adjacent the tip of the spreader, said guideway lying in a plane generally at right angles to the plane of the spreader and being adapted to receive therein said third section of the web so that the web is guided as it advances in downstream direction, the guideway defined by the guide members being laterally aligned with the channel in the guide roller for receiving said third web section after it moves past the tip of the spreader.

17. Apparatus as set forth in claim 12 further comprising a pair of guide members defining a relatively narrow guideway extending downstream with respect to the direction of web travel from adjacent the tip of the spreader, said guideway lying in a plane generally at right angles to the plane of the spreader and being adapted to receive therein a folded third section of the web extending generally at right angles to said second plane so that the web is guided in side-to-side direction as it advances in downstream direction from the tip of the spreader, said third section of web comprising a section of web extending between said closure strips.

18. Apparatus as set forth in claim 12 further comprising a frame, and means mounting said V-shaped member on the frame for movement relative to the frame in a plane parallel to said second plane thereby to adjust the lateral position of the opened web advancing from the web-opening station.

19. Apparatus as set forth in claim 9 further comprising a pressing station along said path between said supply of folded web and said web-opening station, and press means at said pressing station for flattening said closure strips at package-length intervals prior to opening of the web.

20. Apparatus as set forth in claim 19 wherein said closure strips are of plastic and said press means comprises a pair of heated jaws adapted to heat the closure strips to render them heat deformable, and then to press the heated closure strips to flatten them.

21. Apparatus as set forth in claim 20 further comprising means for intermittently pulling web through said pressing and web-opening stations in package-length increments, with a dwell between successive pulls, said jaws being adapted to close during said dwell to flatten the closure strips.

22. Apparatus as set forth in claim 21 further comprising guide means along said path immediately upstream from said press means, said guide means being engageable with web in an area of the web including said interlocked closure strips to guide the web for travel into proper position between said jaws.

23. Apparatus as set forth in claim 9 further comprising supply feed means for feeding folded web from said supply at a rate sufficient to maintain the web in a substantially tension-free condition as it advances toward said guide means.

24. Apparatus as set forth in claim 23 wherein said supply feed means comprises means for rotating a supply roll of folded web thereby to feed folded web from the roll, accumulator means upstream of said guide means for accumulating a surplus of folded web in substantially tension-free condition so that web advancing through said guide means is substantially tension free, and sensor means responsive to the depletion of said surplus due to the advancement of web through the pressing station for signalling operation of said rotating means to feed additional web from said supply roll until said surplus is replenished.

25. Apparatus as set forth in claim 24 wherein said accumulator means comprises a dancer roll interposed between said supply roll and said guide means and defining a path of web travel to the guide means which creates a surplus of web, and means mounting said dancer roll for free up and down movement relative to said supply roll and said guide means, the arrangement being such that the dancer roll is adapted to move upwardly as said surplus of web is depleted and down as said surplus is replenished, said sensor means being responsive to upward movement of the dancer roll to signal for the feed of additional web from said supply roll.

26. Apparatus as set forth in claim 9 further comprising web feeding means intermittently operable for pulling web through said pressing and web-opening stations in package-length increments, with a dwell between each pull to permit flattening of the closure elements at the pressing station during the dwell.

27. Apparatus as set forth in claim 26 further comprising accumulator means downstream from said web feeding means for accumulating a surplus of opened web to permit such web to be fed from the apparatus continuously while said web feeding means operates intermittently, and sensor means responsive to the depletion of said surplus due to the advancement of web from the apparatus for signalling operation of said web feeding means to feed additional web until said surplus is replenished.

28. Apparatus as set forth in claim 27 wherein said accumulator means downstream from said web feeding means comprises a dancer roll defining a path of web travel which creates a surplus of web, and means mounting said dancer roll for free up and down movement while maintaining the dancer roll horizontal, the arrangement being such that the dancer roll is adapted to move up as said surplus of web is depleted and down as said surplus is replenished.

29. Apparatus as set forth in claim 28 wherein said sensor means is responsive to upward movement of the dancer roll to signal said web feeding means to feed additional web.

30. Apparatus as set forth in claim 28 further comprising means for maintaining said dancer roll horizontal as it moves up and down.

* * * * *